US009076424B2

(12) United States Patent
Mizuno

(10) Patent No.: US 9,076,424 B2
(45) Date of Patent: Jul. 7, 2015

(54) ACTIVE NOISE CONTROL DEVICE

(75) Inventor: Ko Mizuno, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 360 days.

(21) Appl. No.: 13/701,532

(22) PCT Filed: Mar. 29, 2012

(86) PCT No.: PCT/JP2012/002205

§ 371 (c)(1),
(2), (4) Date: Dec. 3, 2012

(87) PCT Pub. No.: WO2012/137448

PCT Pub. Date: Oct. 11, 2012

(65) Prior Publication Data

US 2013/0089211 A1 Apr. 11, 2013

(30) Foreign Application Priority Data

Apr. 6, 2011 (JP) ..... 2011-084917

(51) Int. Cl.
*G10K 11/16* (2006.01)
*G10K 11/00* (2006.01)
*G10K 11/178* (2006.01)

(52) U.S. Cl.
CPC ..... *G10K 11/002* (2013.01); *G10K 11/1782* (2013.01); *G10K 2200/10* (2013.01); *G10K 2210/12* (2013.01); *G10K 2210/3215* (2013.01)

(58) Field of Classification Search
None
See application file for complete search history.

(56) References Cited

U.S. PATENT DOCUMENTS 5,343,713 A 9/1994 Okabe et al.
5,524,057 A * 6/1996 Akiho et al. ..... 381/94.7
7,515,719 B2 4/2009 Hooley et al.
7,536,018 B2 * 5/2009 Onishi et al. ..... 381/71.8
7,970,153 B2 * 6/2011 Konagai et al. ..... 381/104
8,559,648 B2 * 10/2013 Christoph ..... 381/71.12
2004/0151325 A1 8/2004 Hooley et al.

(Continued)

FOREIGN PATENT DOCUMENTS

CN 2588714 11/2003
CN 101848288 9/2010

(Continued)

OTHER PUBLICATIONS

Chinese Office Action issued Nov. 4, 2014 in corresponding Chinese Patent Application No. 201280001497.8 (with partial English translation).

(Continued)

*Primary Examiner* — Thang Tran
(74) *Attorney, Agent, or Firm* — Wenderoth, Lind & Ponack, L.L.P.

(57) ABSTRACT

The active noise control device for canceling out a target sound to be controlled in a target area for sound control includes: control sound output units each of which produces a control sound based on a wavefront control signal; and a wavefront control unit which provides the wavefront control signal to the corresponding one of the control sound output units, and the wavefront control unit generates the wavefront control signal to emit a synthesized sound from a virtual sound source toward the target area for sound control and cancel out the target sound in the target area for sound control, the synthesized sound being a sound synthesized from control sounds produced by the respective control sound output units, and the virtual sound source being located at a predetermined position.

7 Claims, 13 Drawing Sheets

(56) References Cited

U.S. PATENT DOCUMENTS

| | | | | |
|---|---|---|---|---|
| 2005/0053244 | A1* | 3/2005 | Onishi et al. | 381/71.11 |
| 2007/0110268 | A1* | 5/2007 | Konagai et al. | 381/335 |
| 2007/0253564 | A1* | 11/2007 | Katayama et al. | 381/63 |
| 2009/0161880 | A1 | 6/2009 | Hooley et al. | |
| 2012/0300955 | A1* | 11/2012 | Iseki et al. | 381/71.4 |
| 2013/0039512 | A1* | 2/2013 | Miyata et al. | 381/97 |

FOREIGN PATENT DOCUMENTS

| | | | |
|---|---|---|---|
| JP | 3072174 | | 7/2000 |
| JP | 2006121125 | A * | 5/2006 |
| JP | 2007-236005 | | 9/2007 |
| JP | 2008-179979 | | 8/2008 |

OTHER PUBLICATIONS

International Search Report issued May 1, 2012 in International (PCT) Application No. PCT/JP2012/002205.

Edwin Nico Gerard Verheijen, "Sound Reproduction by Wave Field Synthesis", Delft University of Technology, 1997.

* cited by examiner

ACTIVE NOISE CONTROL DEVICE

TECHNICAL FIELD

The present invention relates to an active noise control device for canceling out a noise in a target area for sound control.

BACKGROUND ART

As a conventional active noise control device, a device is disclosed which is capable of reducing a noise (a target sound) from a noise source in a wide range by producing a synthesized control sound with an opposite phase to the noise, which is produced by multiple speakers arranged around the noise source (see, Patent literature (PTL) 1 for example).

FIG. 1A illustrates a cross-sectional view showing a vertical section of an air-conditioning indoor equipment 1 including the conventional active noise control device as described in PTL 1, and FIG. 1B illustrates a plan view (a bottom view) showing a air-conditioning indoor equipment 1 depicted from the bottom of it in FIG. 1A.

As shown in FIG. 1A and FIG. 1B, the air-conditioning indoor equipment 1 includes a turbofan 2 which generates a noise, heat exchangers 3, a suction grille 4 provided in the bottom of the air-conditioning indoor equipment 1, and a sound generation unit 5 for emitting the synthesized control sound with the opposite phase in the same direction as a direction of propagation of the noise generated by the turbofan 2 (in a downward direction in FIG. 1A).

As shown in FIG. 1B, the sound generation 5 includes five speakers 5*a* to 5*e* which are provided around an air flow channel 6 and have an array arrangement. A distance d between the speakers 5*a* and 5*e* is less than a one-half wavelength of sound at the highest frequency of the noise generated by the turbofan 2. Like the distance d between the speakers 5*a* and 5*e*, a distance h between the speaker 5*a* and the turbofan 2 is also less than a one-half wavelength of sound at the highest frequency of the noise. Thus, since the turbofan 2 and the speaker 5*a* are placed close to each other and the speakers 5*a* to 5*e* are also placed closely so that both of the distances h and d are less than the wavelength of sound at the highest frequency of the noise, a propagating wave front of the noise roughly coincides with a propagating wave front of the control sound with the opposite phase which is synthesized by the speakers 5*a* to 5*e*. Therefore, the noise can be widely reduced in a three-dimensional space.

CITATION LIST

Patent Literature

[PTL 1] Japanese Patent No. 3072174

SUMMARY OF INVENTION

Technical Problem

However, in the above-mentioned conventional active noise control device, when the highest frequency of a noise is 500 [Hz] for example, the turbofan 2 and the speakers 5*a* to 5*e* need to be placed so that both of the distance h between the turbofan 2 and the speaker 5*a* and the distances d between the speakers 5*a* to 5*e* are not more than 34 [cm] that is a one-half wavelength of 500 [Hz]. Accordingly, the conventional active noise control device has a problem that this approach is not applicable to equipment with no space to provide the sound generation unit 5 around a noise source.

It should be noted that a larger distance between the noise source and the sound generation unit generally decreases an area where the noise can be reduced. For this reason, the equipment with limited installation space which includes the active noise control device provided some distance away from the noise source narrows an area where the noise is reduced, and the noise may fail to be reduced in an entire area intended to reduce the noise (a target area for sound control).

In view of this, it is an object of the present invention to provide the active noise control device which does not need to be placed in a neighborhood of the noise source, and is capable of reducing the noise in a wide range.

Solution to Problem

To solve the above problems, an active noise control device according to the present invention is an active noise control device for canceling out a target sound to be controlled in a target area for sound control desired, the active noise control device including: a plurality of control sound output units each of which produces a control sound based on a wavefront control signal; and a wavefront control unit which provides the wavefront control signal to the corresponding one of the control sound output units, in which the wavefront control unit generates the wavefront control signal to emit a synthesized sound from a virtual sound source toward the target area for sound control and cancel out the target sound in the target area for sound control, the synthesized sound being a sound synthesized from control sounds produced by the respective control sound output units, and the virtual sound source being located at a predetermined position.

Advantageous Effects of Invention

An active noise control device according to the present invention can widely reduce a noise even if the device has limited installation space.

DESCRIPTION OF EMBODIMENTS

Figure 1A:
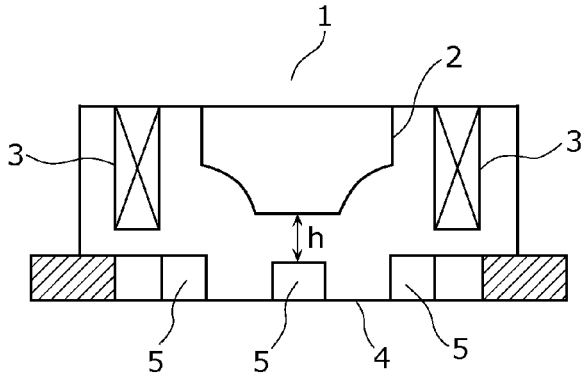
FIG. 1A PRIOR ART
FIG. 1A illustrates a schematic cross-sectional view showing an exemplary structure of an air-conditioning indoor equipment including a conventional active noise control device.
Figure 1B:
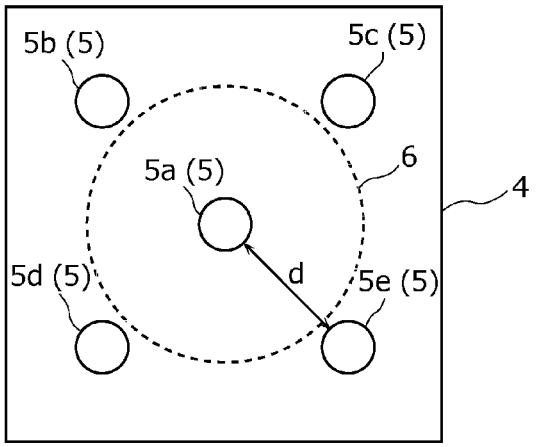
FIG. 1B PRIOR ART
FIG. 1B illustrates a schematic plane view (a bottom view) showing the exemplary structure of the air-conditioning indoor equipment including the conventional active noise control device.

Outline of Active Noise Control Device According to Present Invention

An active noise control device according to the present invention is an active noise control device for canceling out a target sound to be controlled in a target area for sound control desired, the active noise control device including: a plurality of control sound output units each of which produces a control sound based on a wavefront control signal; and a wavefront control unit which provides the wavefront control signal to the corresponding one of the control sound output units, in which the wavefront control unit generates the wavefront control signal to emit a synthesized sound from a virtual sound source toward the target area for sound control and cancel out the target sound in the target area for sound control, the synthesized sound being a sound synthesized from control sounds produced by the respective control sound output units, and the virtual sound source being located at a predetermined position.

With this, an installation position of a sound output unit is not limited to a neighborhood of a noise source and a noise can be widely reduced regardless of a relative position between the noise source and the sound output unit.

It should be noted that the "canceling out a target sound" means not only completely canceling out the target sound, but also reducing the target sound. Preferably, that means reducing it to a negligible level.

It is further preferable that an aspect of the active noise control device according to the present invention be the active noise control device, in which, when a non-target area for sound control is located in a traveling direction of the target sound emitted from a noise source and the target area for sound control is located in a different direction from the traveling direction, the non-target area for sound control being an area where the target sound can be heard, the wavefront control unit generates the wavefront control signal to emit the synthesized sound from the virtual sound source toward the different direction.

It is further preferable that an aspect of the active noise control device according to the present invention be the active noise control device, in which the wavefront control unit sets the wavefront control signal for producing the synthesized sound having a phase opposite to a phase of the target sound in the target area for sound control and an amplitude equal to an amplitude of the target sound.

It is further preferable that an aspect of the active noise control device according to the present invention be the active noise control device, in which the wavefront control unit includes: a reverse unit which generates a reverse signal by reversing a phase of an input signal to be used to generate the control sounds; a delay correction unit which generates a delayed reverse signal by providing a predetermined amount of delay to the reverse signal; and a digital filtering unit which generates the wavefront control signal by performing the digital filtering on the delayed reverse signal.

It is further preferable that an aspect of the active noise control device according to the present invention be the active noise control device, in which the wavefront control unit includes: a wavefront calculation unit configured to perform (i) a noise transfer function calculation process in which a noise transfer function is calculated based on a detection result obtained by, under a condition that the target sound is being emitted, stopping production of the control sounds and detecting the target sound using a detection device for detecting a sound, and (ii) a synthesized-sound transfer function calculation process in which a synthesized-sound transfer function is calculated based on a detection result obtained by, under a condition that no target sound is being emitted, producing setup control sounds from the respective control output units and detecting a setup synthesized sound using the detection device, the setup synthesized sound being a sound synthesized from the setup control sounds; and a delay amount control unit which sets the amount of delay based on the noise transfer function and the synthesized sound transfer function calculated in the wavefront calculation unit.

It is further preferable that an aspect of the active noise control device according to the present invention be the active noise control device, in which the wavefront control unit further includes: a gain correction unit which adjusts a gain of the delayed reverse signal based on a gain correction value; and a gain control unit which determines the gain correction value based on the noise transfer function and the synthesized sound transfer function calculated in the wavefront calculation unit, the gain correction value being a value for increasing a degree of coincidence between a wave front of the synthesized sound and a wave front of the target sound.

It is further preferable that an aspect of the active noise control device according to the present invention be the active noise control device, in which the detection device includes at least two microphones which are arranged at regular intervals along a circular arc formed by points having a same phase in the synthesized sound.

The following paragraphs describe embodiments of the present invention with reference to drawings. It should be noted that each of the embodiments described below is a preferable, specific example of the present invention. The constituent elements, the arrangement and connection of the constituent elements, steps, the processing order of the steps etc. shown in the following embodiments are mere examples, and thus do not limit the present invention. Thus, among the constituent elements in the following embodiments, constituent elements not recited in any of the independent claims indicating the most generic concept of the present invention are described as preferable constituent elements.

Embodiment 1

An active noise control device according to an embodiment 1 of the present invention is described with reference to FIG. 2A to FIG. 11.

The active noise control device according to the embodiment 1 of the present invention includes control speakers (corresponding to control sound output units) and a wavefront control unit which controls the control speakers, and cancels out a target sound in an intended target area for sound control using a sound synthesized from control sounds produced by the respective control speakers.

Figure 2A:
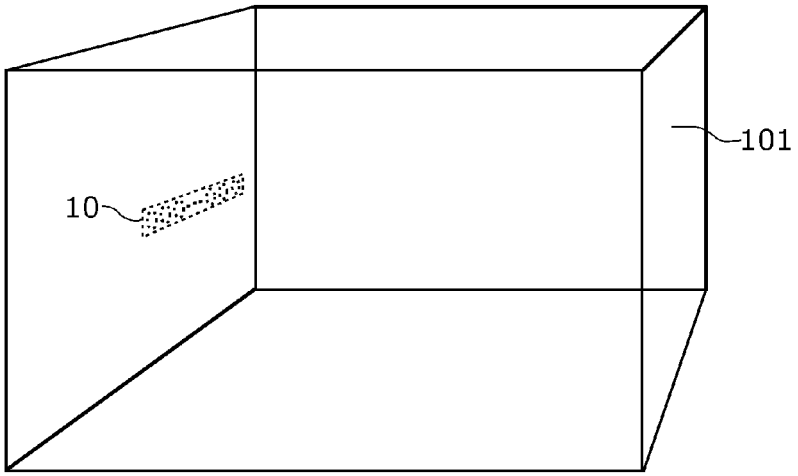
FIG. 2A illustrates a schematic view showing an exemplary arrangement of the active noise control device according to an embodiment 1 of the present invention.
Figure 2B:
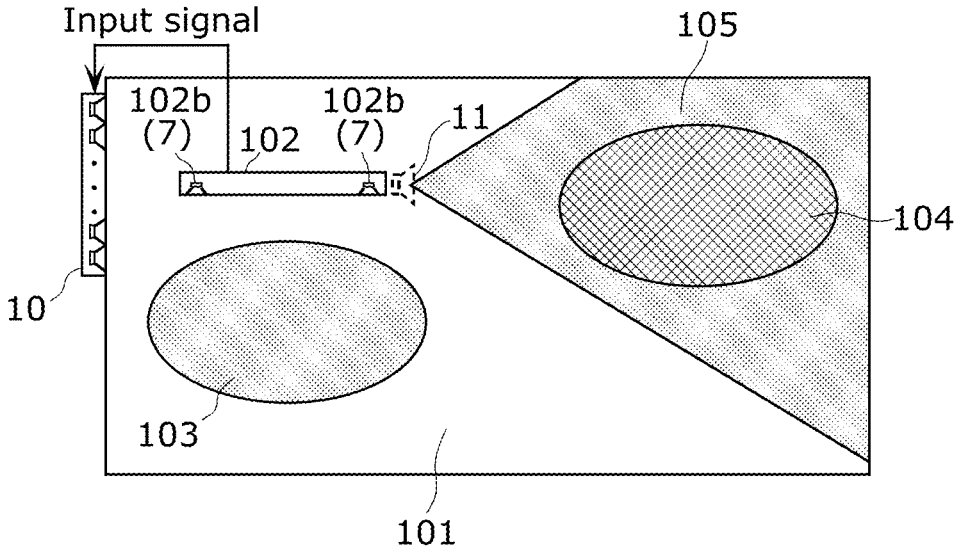
FIG. 2B illustrates a schematic block diagram showing a relative position between a noise source and the active noise control device according to the embodiment 1 of the present invention.

FIG. 2A illustrates a schematic block diagram showing an exemplary arrangement of the active noise control device according to the embodiment 1 of the present invention. FIG. 2B illustrates a schematic block diagram showing a relative position between a noise source and the active noise control device according to the embodiment 1 of the present invention, and corresponds to a top view of residence space in FIG. 2A.

As shown in FIG. 2A and FIG. 2B, the embodiment 1 of the present invention assumes that the active noise control device 10 is applied to a normal room 101. As shown in FIG. 2B, the room 101 has a TV 102 which is placed so as to emit a sound toward a TV viewing area 103 (a non-target area for sound control) located at the lower side of the drawing. In the embodiment 1, the speakers 102*a*, 102*b* of the TV 102 and sounds emitted from them are regarded as the noise source 7 and the target sound, respectively.

In addition, the active noise control device 10 is fixed and mounted in a left side wall, as shown in FIG. 2A and FIG. 2B. In other wards, the active noise control device 10 according to the embodiment 1 is located some distance away from the noise source 7 which generates a target sound. The active noise control device 10 is configured to emit a synthesized sound from the virtual source 11 located at a position of the TV 102 toward the target area for sound control 104 located at the right side of the drawing so as to cancel out the target sound.

It should be noted that the embodiment 1 assumes that the active noise control device 10 is applied to a normal house, but the application is not limited to this. Other space such as an office may be applicable. In addition, the target sound is not limited to the sound emitted from the speakers 102*a*, 102*b* of the TV 102. A sound emitted from another video device such as an audio device may be applicable. In this case, a device which emits the sound is regarded as the noise source 7. Furthermore, the target area for sound control 104 and the non-target area for sound control are appropriately set depending on a usage situation of the room or the noise source 7.

(Structure of Active Noise Control Device according to Embodiment 1)

Figure 3:
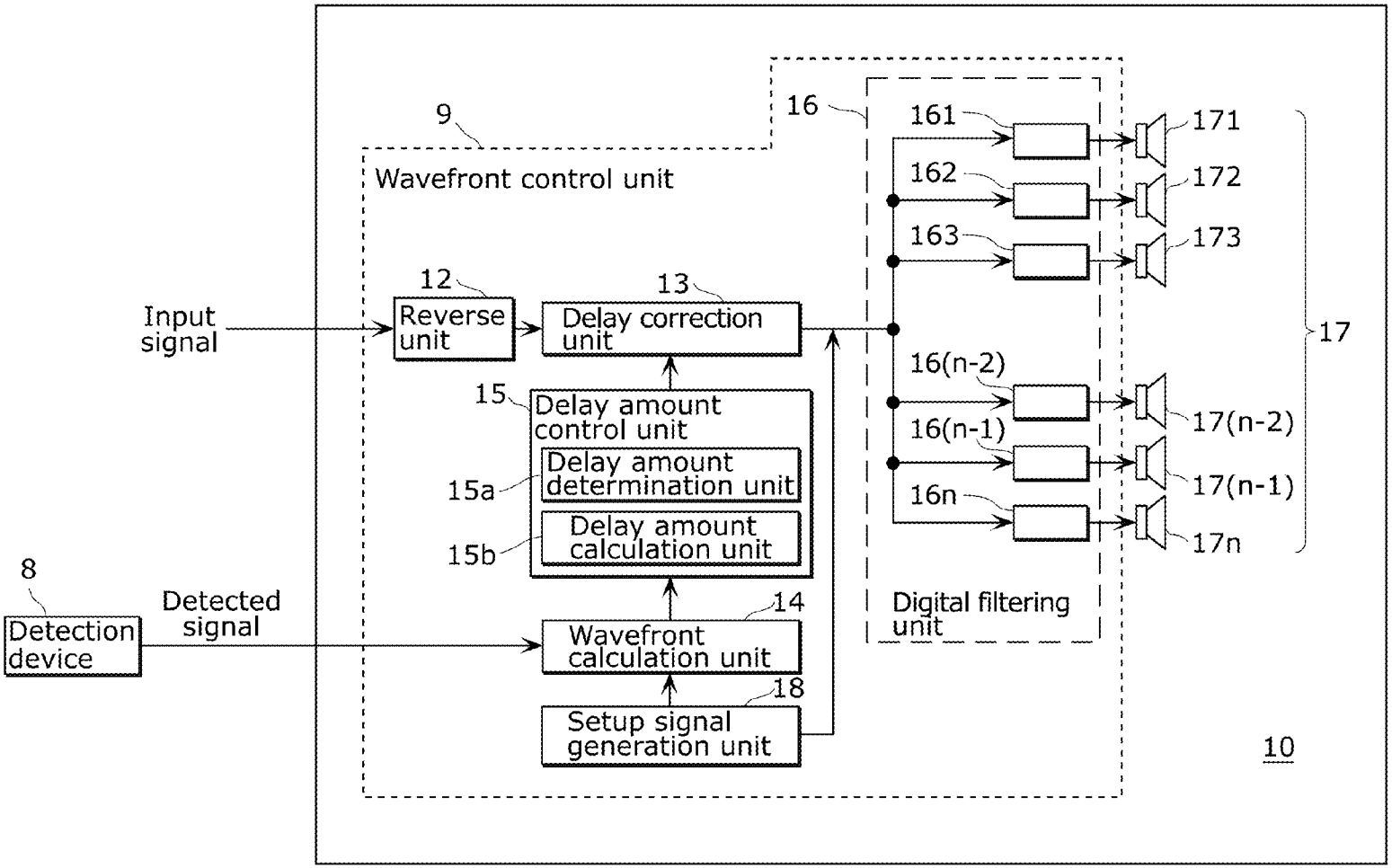
FIG. 3 illustrates a schematic block diagram showing an exemplary structure of the active noise control device according to the embodiment 1 of the present invention.

A structure of the active noise control device according to the embodiment 1 is described with reference to FIG. 3. FIG. 3 illustrates a schematic block diagram showing an exemplary structure of the active noise control device 10 according to the embodiment 1.

As shown in FIG. 3, the active noise control device 10 includes a wavefront control unit 9 including a reverse unit 12, a delay correction unit 13, a wavefront calculation unit 14, a delay amount control unit 15, a digital filtering unit 16 including control filters 161, 162, . . . , 16*n* (n represents an integer of 2 or greater), and a setup signal generation unit 18, a sound output unit 17 including control speakers 171, 172, . . . , 17*n* (corresponding to the control sound output units), an input signal terminal for receiving an input signal to produce the control sounds (not shown), and one or more detection signal terminals for receiving one or more detected signals provided from a detection device 8 which detects a sound (not shown). It should be noted the input signal terminal and the detection signal terminal are exemplified in the embodiment 1 as components for receiving the input signal and the detected signal, but a method of receiving the input signal and the detected signal is not limited to the input signal terminal and the detection signal terminal, respectively. In addition, the detection device 8 is not essential to the present invention.

The reverse unit 12 generates a reverse signal by reversing a phase of the input signal and provides the reverse signal to the delay correction unit 13. This embodiment assumes that the input signal is a signal for causing the speakers 102*a*, 102*b* to produce a sound, i.e. a broadcast signal. It should be noted that, when an audio device or the like is used as the noise source 7, a signal to produce a sound in the audio device is received as the input signal.

The delay correction unit 13 generates a delayed reverse signal by providing an amount of delay determined in the delay amount control unit 15 to the reverse signal provided from the reverse unit 12, and provides the delayed reverse signal to the digital filtering unit 16.

The wavefront calculation unit 14 calculates, based on the one or more detected signals provided from the detection device 8, one or more noise transfer functions each representing a distribution of wave fronts of the target sound and one or more synthesized-sound transfer functions each representing a distribution of wave fronts of a setup synthesized sound synthesized from setup control sounds, and provides these functions to the delay amount control unit 15 in a form of wavefront information.

The delay amount control unit 15 sets, based on the wavefront information provided from the wavefront calculation unit 14, the amount of delay which is provided to the reverse signal so that a phase of a noise wave front 7*w* is opposite to a phase of a synthesized-sound wave front 11*w*. More specifically, in the embodiment 1, the delay amount control unit 15 includes (i) a delay amount calculation unit 15*b* which calculates a difference $\Delta_T$ between a time delay of an impulse response derived from the noise transfer function of the target sound and a time delay of an impulse response derived from the synthesized-sound transfer function of the setup synthesized sound and (ii) a delay amount determination unit 15*a* which determines the amount of delay to the reverse signal based on the difference $\Delta_T$.

In the digital filtering unit 16, the control filter 16*i* (i=1 to n) performs a digital filtering on the delayed reverse signal provided from the delay correction unit 13 using a filter coefficient as described below, and then activates a control speaker 17*i*. The digital filtering unit 16 generates a wavefront control signal so that (i) a virtual sound source 11 for the synthesized sound synthesized from control sounds is located at a predetermined position, (ii) a sound from the virtual sound source 11 is emitted toward the target area for sound control 104, and (iii) an area defined as circular arcs each of which is formed by points having the same phase in the synthesized sound is overlapped with the target area for sound control 104, and then the wavefront control signal is provided the control speaker 17*i*.

More specifically, assuming that the virtual sound source 11 is a point sound source, the control filter 16*i* performs the digital filtering on an input signal using the filter coefficient calculated according to a well-known wave field synthesis theory, and then activates the control speaker 17*i* (an activation process). It should be noted that the wave field synthesis theory is a theory in which the control sound is set for each of the control speakers so as to obtain intended wave field of the synthesized sound synthesized from the control sounds produced from the respective control speakers that are arranged in a line. Details of the wave field synthesis theory are disclosed in "Sound reproduction by wave field synthesis] Delft University of Technology", Edwin Verheijen, 1997, (non patent literature) for example.

Figure 4:
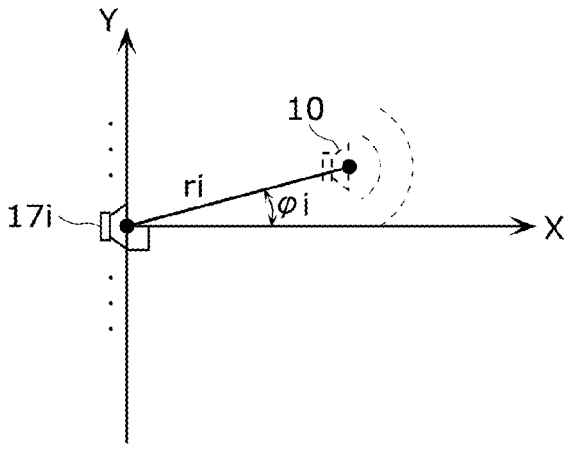
FIG. 4 illustrates a view showing a frame format of parameters used in a calculation of a filter coefficient according to a wave field synthesis theory.

The filter coefficient to be used for the digital filtering in the control filter 16*i* is described with reference to FIG. 4. FIG. 4 illustrates a view showing a frame format of parameters in a filter-coefficient math formula according to a wave field synthesis theory. In FIG. 4, Cartesian coordinate system is used, and the control speakers 171 to 17*n* are arranged along the y-axis.

The filter coefficient of the control filter 16*i* is represented as a function of frequency ω. When the virtual sound source 11 is located in the traveling direction of the control sounds produced by the respective control speakers 171 to 17*n*, the filter coefficient $Q_i(\omega)$ is calculated by the following equation (1) using a length $r_i$ of a line segment between the control speaker 17*i* and the virtual sound source 11 and an angle $\phi_i$ between the x-axis and the line segment.

[Math. 1]

$$Q_i(\omega) = \alpha\sqrt{\frac{k}{2\pi j}}\cos\varphi_i\frac{\exp(jkr_i)}{\sqrt{r_i}} \tag{1}$$

In the equation (1), k is frequency [Hz]/sound velocity [m/s], and α is a parameter for determining a filter gain, which is used to adjust the synthesized-sound wave front 11*w* to have a level equal to a level of the noise wave front 7*w*.

The length $r_i$ and the angle $\phi_i$ are determined depending on a position of the virtual sound source 11 with respect to the control speaker 17*i*, and, in the embodiment 1, the virtual sound source 11 is located at a position of the noise source 7 (the speaker 102*b* of the TV 102). The embodiment 1 assumes that the noise source 7 is located at a distance of 2 [m] before the sound output unit 17 (at a position where $r_i \times \cos\phi_i = 2$).

It should be noted that the fixed filter coefficients $Q_1(\omega)$ to $Q_n(\omega)$ are preset because the embodiment 1 assumes that the control speakers 171 to 17*n* and the virtual sound source 11 are fixed.

The sound output unit 17 produces the control sounds based on the respective wavefront control signals. The embodiment 1 assumes that the sound output unit 17 includes the 32 control speakers 171 to 1732 (n=32) arranged at regular intervals of 12 [cm].

(Operation of Active Noise Control Device according to Embodiment 1)

Figure 5:
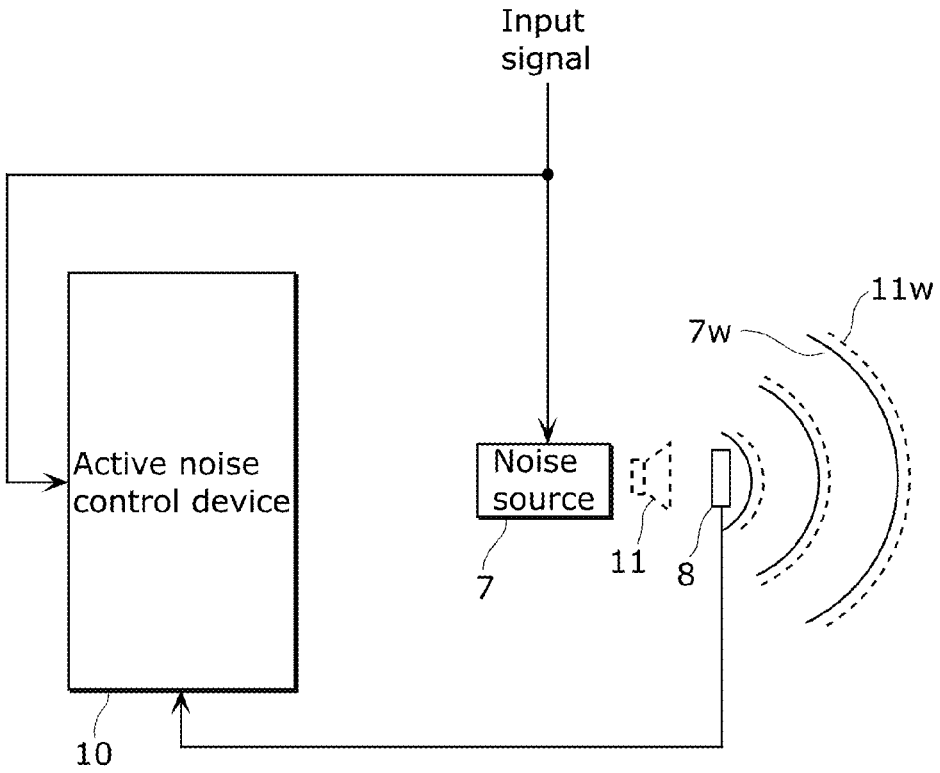
FIG. 5 illustrates a schematic plane view (a top view) showing a relative position between the noise source and the active noise control device according to the embodiment 1 of the present invention.

Next, an operation of the active noise control device 10 according to the embodiment 1 is described with reference to FIG. 5. FIG. 5 illustrates a schematic block diagram showing a positional relationship among the noise source 7 which generates the noise, the noise wave front 7*w* representing a locus of points having the same phase of noise, the detection device 8 which detects a sound, the active noise control device 10, the virtual sound source 11 for the synthesized sound synthesized from the control sounds emitted from the active noise control device 10, and the synthesized-sound wave front 11*w* representing a locus of points having the same phase of the synthesized sound. As shown in FIG. 5, in the embodiment 1, the virtual sound source 11 is located at the position of the noise source 7 (the speakers 102*a*, 102*b* of the TV 102). In addition, the detection device 8 is assumed to include microphones.

The active noise control device 10 performs a usual sound control operation and a delay setup operation for setting the amount of delay to be used for the sound control operation.

In the embodiment 1, the sound control operation is assumed to be always performed when the noise is emitted from the noise source 7, but an execution of the sound control operation may be set by a manipulated input for example. Also, in the embodiment 1, the delay setup operation is assumed to be performed only once after an installation of the active noise control device 10 and before the first sound control operation, but it is possible to perform every time before the sound control operation.

(Sound Control Operation)

In the usual sound control operation, the reverse unit 12 in the active noise control device 10 generates the reverse signal by reversing the phase of the input signal (the broadcast signal) (a reverse signal generation process).

Upon receiving the reverse signal from the reverse unit 12, the delay correction unit 13 provides the amount of delay, which is determined by the delay amount control unit 15 in the delay setup operation, to the reverse signal, and then provides the delayed reverse signal (a delay correction process).

Furthermore, the control filter 16*i* (i=1 to n) performs the digital filtering on the delayed reverse signal, and activates the control speaker 17*i* to produce the control sound (an activation process). With this, the target sound can be canceled out.

(Delay Setup Operation)

In the delay setup operation, the active noise control device 10 calculates, based on the detected signal provided from the detection device 8, the amount of delay to adjust an output timing of the control sounds so that the synthesized-sound wave front 11*w* has an opposite phase to the noise wave front 7*w*.

More specifically, first, the wavefront calculation unit 14 calculates the noise transfer functions for the position of the detection device 8 based on the input signal and the detected signals under a condition that (i) the target sound is being emitted from the noise source 7 and (ii) the control sounds are not being produced by the respective control speakers 171 to 17*n* (a noise transfer function calculation process). In other words, the noise transfer functions for the position of the detection device 8 are calculated based on the broadcast signal and the detected signals under the condition that (i) the sound is being emitted from the speakers 102*a*, 102*b* of the TV 102 and (ii) the control sounds are not being produced.

Figure 6:
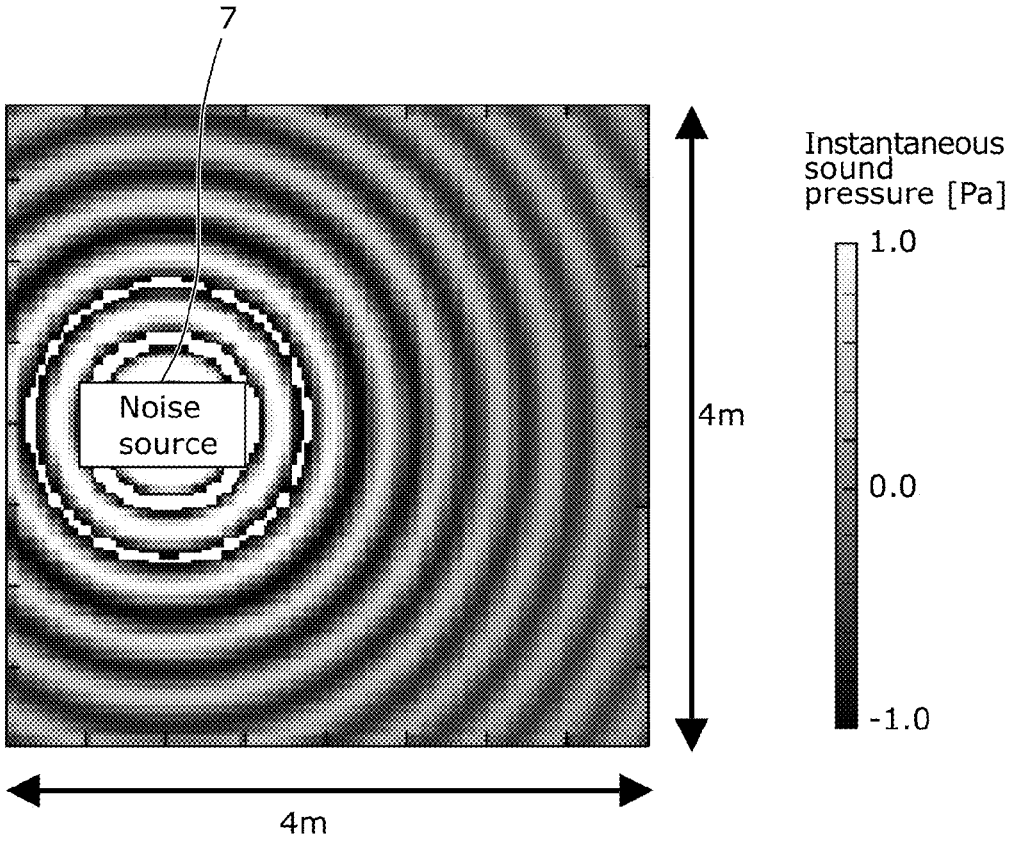
FIG. 6 illustrates a wave field showing exemplary wave fronts of a noise that is a target sound emitted from the noise source.

FIG. 6 illustrates a sound emitted from the noise source 7 which is regarded as the point sound source, more specifically, a distribution of instantaneous sound pressure for 1.5 [kHz] component, i.e. a wave field showing the noise wave fronts 7*w*.

Figure 7:
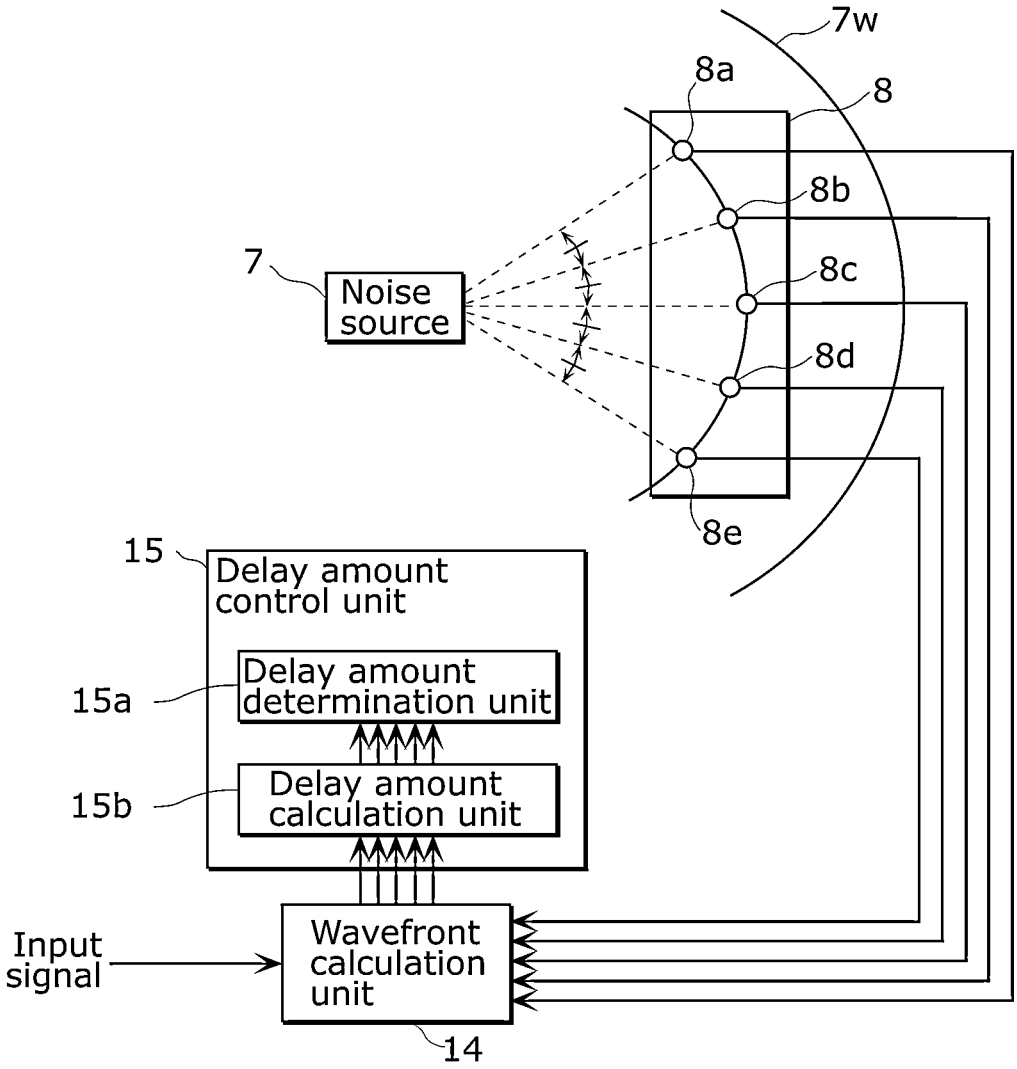
FIG. 7 illustrates a schematic partial block diagram showing a part related to a calculation of a noise transfer function in the active noise control device according to the embodiment 1 of the present invention.

FIG. 7 illustrates a schematic block diagram showing the detection device 8 and a part of the active noise control device 10, which is related to the calculation of the noise wave front 7*w*. In FIG. 7, the detection device 8 includes the microphones 8*a* to 8*e*. The microphones 8*a* to 8*e* are equiangularly arranged in a circular arc around the noise source 7. It should be noted that the embodiment 1 assumes that the detection device 8 includes five microphones 8*a* to 8*e*, but not limited to this.

Next, the wavefront calculation unit 14 calculates the synthesized-sound transfer function for the synthesized-sound wave front 11*w* (a synthesized-sound transfer function calculation process).

First, the setup signal generation unit 18 generates an setup input signal, and then provides the setup input signal to the control filters 161 to 16*n* and the wavefront calculation unit 14. It should be noted that the embodiment 1 assumes that the setup signal generation unit 18 is included in the active noise control device 10 and generates the setup input signal, but not limited to this. The setup signal generation unit 18 is not essential to the present invention. The setup signal generation unit 18 may be provided outside for example. In addition, the input signal for a usual operation may be used as the setup input signal.

Each of the control filters 161 to 16*n* performs the digital filtering on the provided setup input signal, and activates a corresponding one of the control speakers 171 to 17*n* to produce a corresponding setup control sound. After this, each of the microphones 8*a* to 8*e* detects a setup synthesized sound synthesized from the setup control sounds, and then provides the detected sound to the wavefront calculation unit 14 as a detected signal.

The wavefront calculation unit 14 calculates the synthesized-sound transfer functions of the synthesized sound for positions of the microphones 8*a* to 8*e*, based on the setup input signal generated by the setup signal generation unit 18 and the detected signals provided from the microphones 8*a* to 8*e* under a condition that no noise is being emitted from the noise source 7, respectively.

Figure 8:
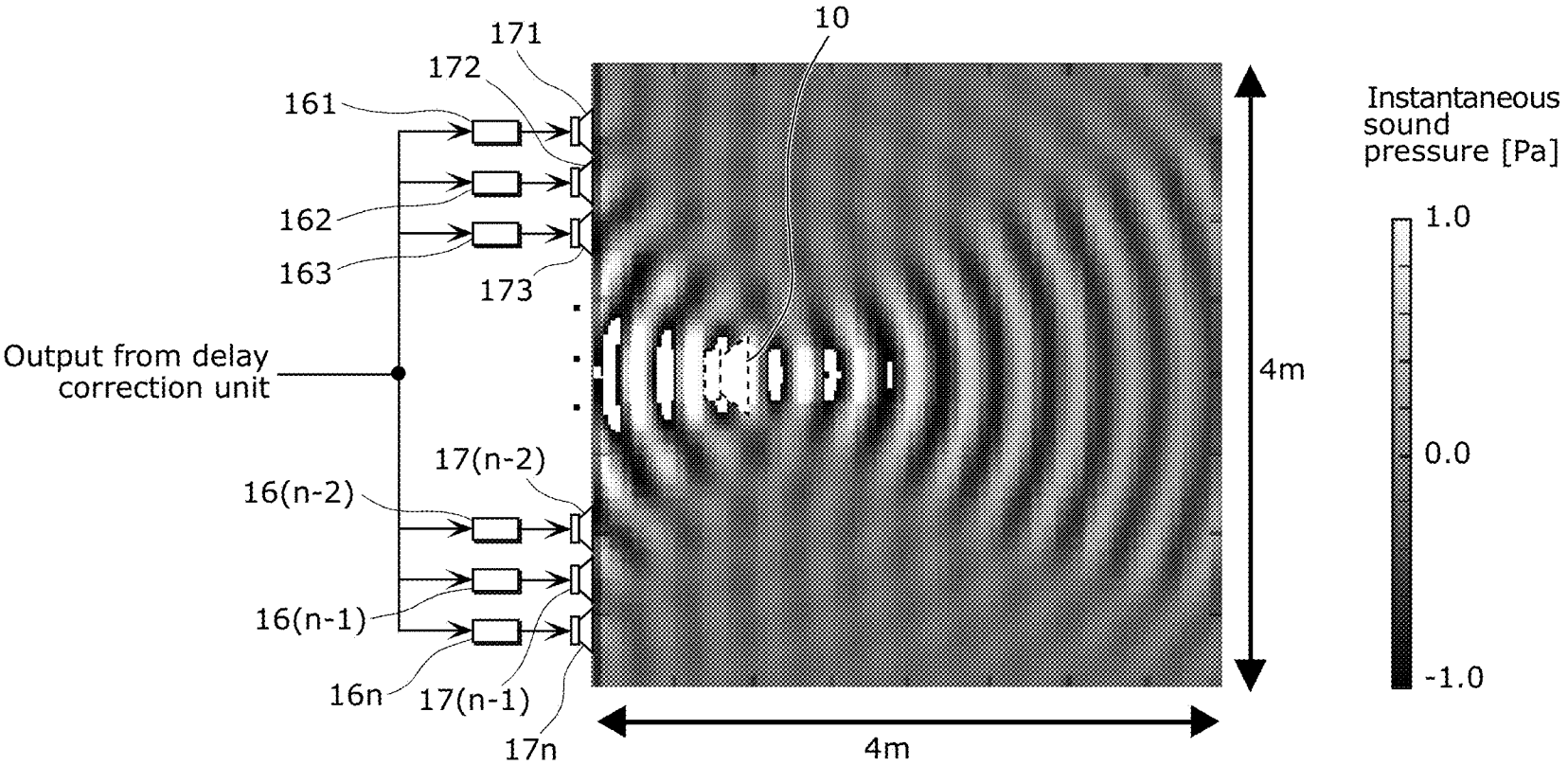
FIG. 8 illustrates a wave field showing exemplary wave fronts of a synthesized sound when a virtual sound source is created as a point sound source.

FIG. 8 illustrates a distribution of instantaneous sound pressure for 1.5 [kHz] component of the synthesized sound, i.e. a wave field showing the synthesized-sound wave fronts 11*w*, where the virtual sound source 11 is a point sound source located at a distance of 1 [m] before the sound output unit 17 (at a position where $r_i \times \cos \phi_i = 1$).

Figure 9:
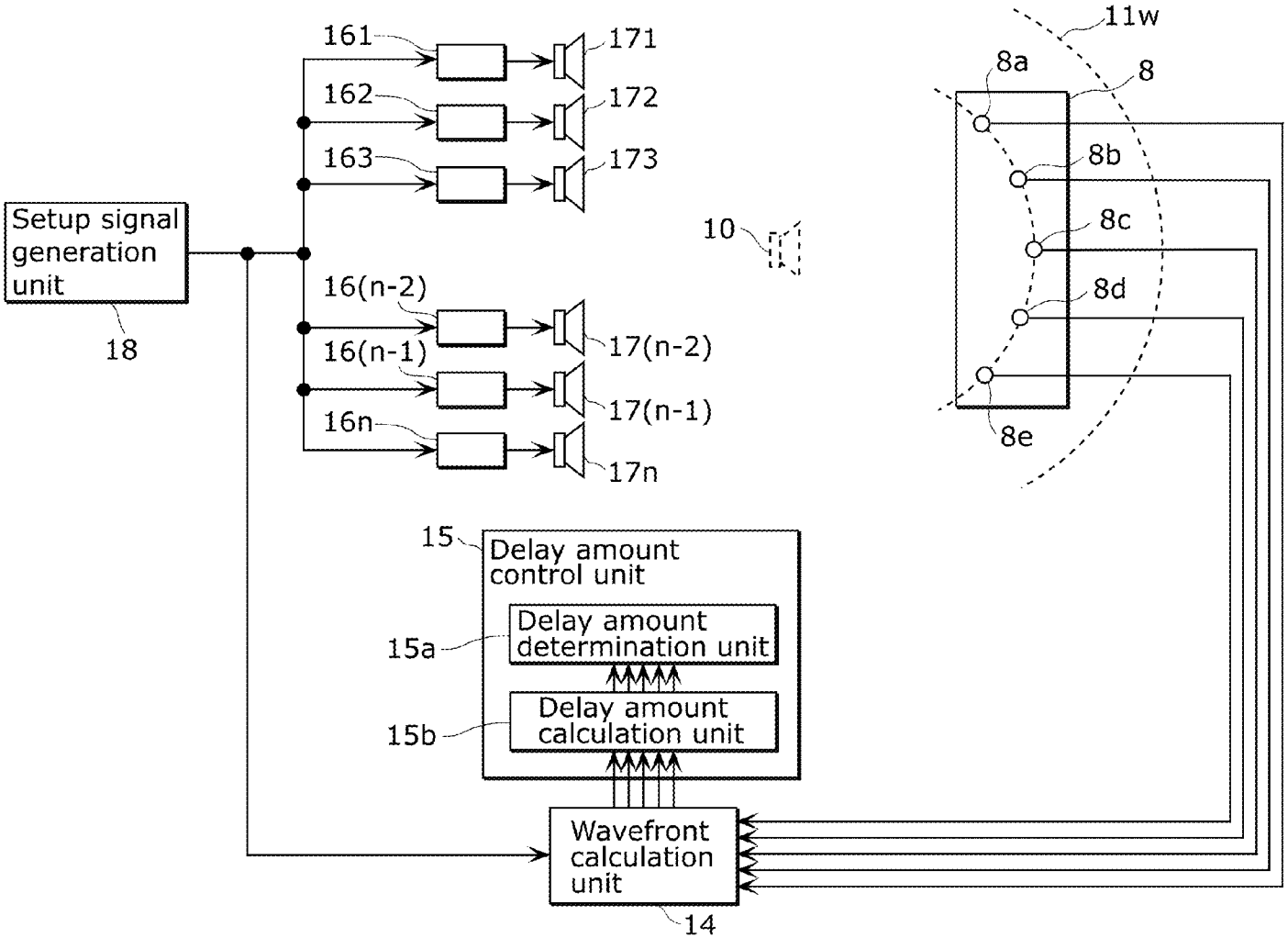
FIG. 9 illustrates a schematic partial block diagram showing a part related to a calculation of a synthesized-sound transfer function in the active noise control device according to the embodiment 1 of the present invention.

FIG. 9 illustrates a schematic block diagram showing the virtual sound source 11, the detection device 8 and a part of the active noise control device 10, which is related to the calculation of the synthesized-sound wave front 11*w*. It should be noted that the detection device 8 shown in FIG. 9 has the same structure as shown in FIG. 7.

Subsequently, the delay amount control unit 15 determines the amount of delay to the reverse signal based on the noise transfer functions and the synthesized-sound transfer functions calculated in the wavefront calculation unit 14 so that the synthesized-sound wave front 11*w* propagates at the same timing as the noise wave front 7*w*.

Figure 10A:
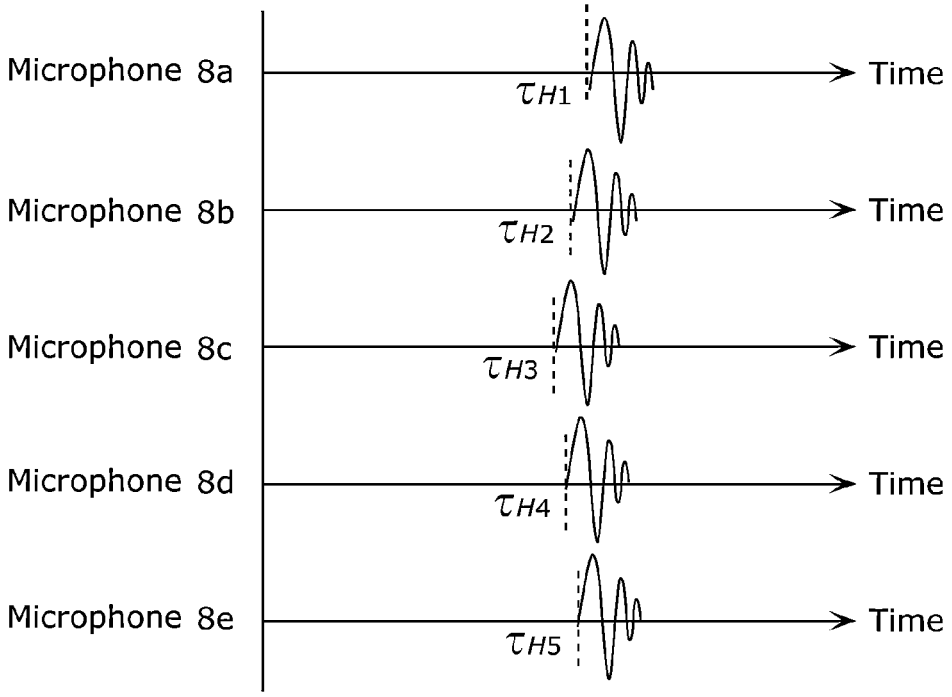
FIG. 10A illustrates waveform charts showing impulse responses of noise transfer functions.
Figure 10B:
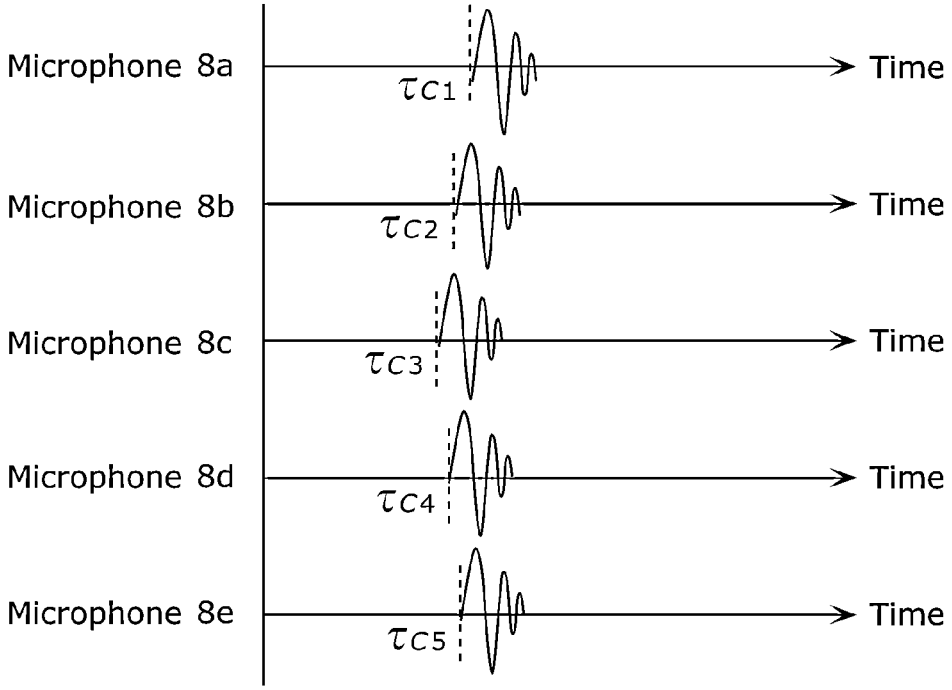
FIG. 10B illustrates waveform charts showing impulse responses of synthesized-sound transfer functions.

FIG. 10A illustrates waveform charts showing exemplary impulse responses of the noise transfer functions, and FIG. 10B illustrates waveform charts showing exemplary impulse responses of control sound transfer functions. As shown in FIG. 10A, time delays of impulse responses derived from the noise transfer functions, which correspond to the detected signals from the microphones 8*a* to 8*e*, are represented as $\tau_{H1}$ to $\tau_{H5}$, respectively, and as shown in FIG. 10B, time delays of impulse responses derived from the noise transfer functions, which correspond to the detected signals from the microphones 8*a* to 8*e*, are represented as $\tau_{C1}$ to $\tau_{C5}$, respectively. Since the noise source 7 has a predetermined size in general, the noise source is not an ideal point sound source and the noise wave front 7*w* is non-isotropic. So, the time delays $\tau_{H1}$ to $\tau_{H5}$ are different. The synthesized-sound wave front 11*w* is also non-isotropic due to distances between the speakers 171 to 17*n* and directional characteristics of the speakers 171 to 17*n*, and thus the time delays $\tau_{C1}$ to $\tau_{C5}$ are different. In view of this, the delay amount calculation unit 15*b* in the delay amount control unit 15 calculates an average of the differences $\Delta_T$ between the time delays $\tau_{H1}$ to $\tau_{H5}$ and $\tau_{C1}$ to $\tau_{C5}$ using the following equation (2).

[Math. 2]

$$\Delta\tau = \frac{\sum_{n=1}^{5} \tau_{Hi}}{5} - \frac{\sum_{n=1}^{5} \tau_{Ci}}{5} \tag{2}$$

The delay amount determination unit 15*a* in the delay amount control unit 15 sets the amount of delay to the $\Delta_T$, and provides information indicating the amount of delay to the delay correction unit 13. The delay setup operation as mentioned above can adjust the output timing of the control sounds produced by the respective control speakers 171 to 17*n* so that the synthesized-sound wave front 11*w* propagates at the same timing as the noise wave front 7*w*.

It should be noted that, in the embodiment 1, as shown in FIG. 8 and FIG. 6, the synthesized-sound wave front 11*w* shown in FIG. 5 is substantially the same as the noise wave front 7*w* in a large area located in a direction away from the virtual sound source 11 (the right side in the drawing) since the active noise control device 10 produces the control sounds so that the virtual sound source 11 is substantially located at the position of the noise source 7. By setting the area to cover the entire target area for sound control 104, the target sound can be canceled out in the entire target area for sound control 104.

Figure 11:
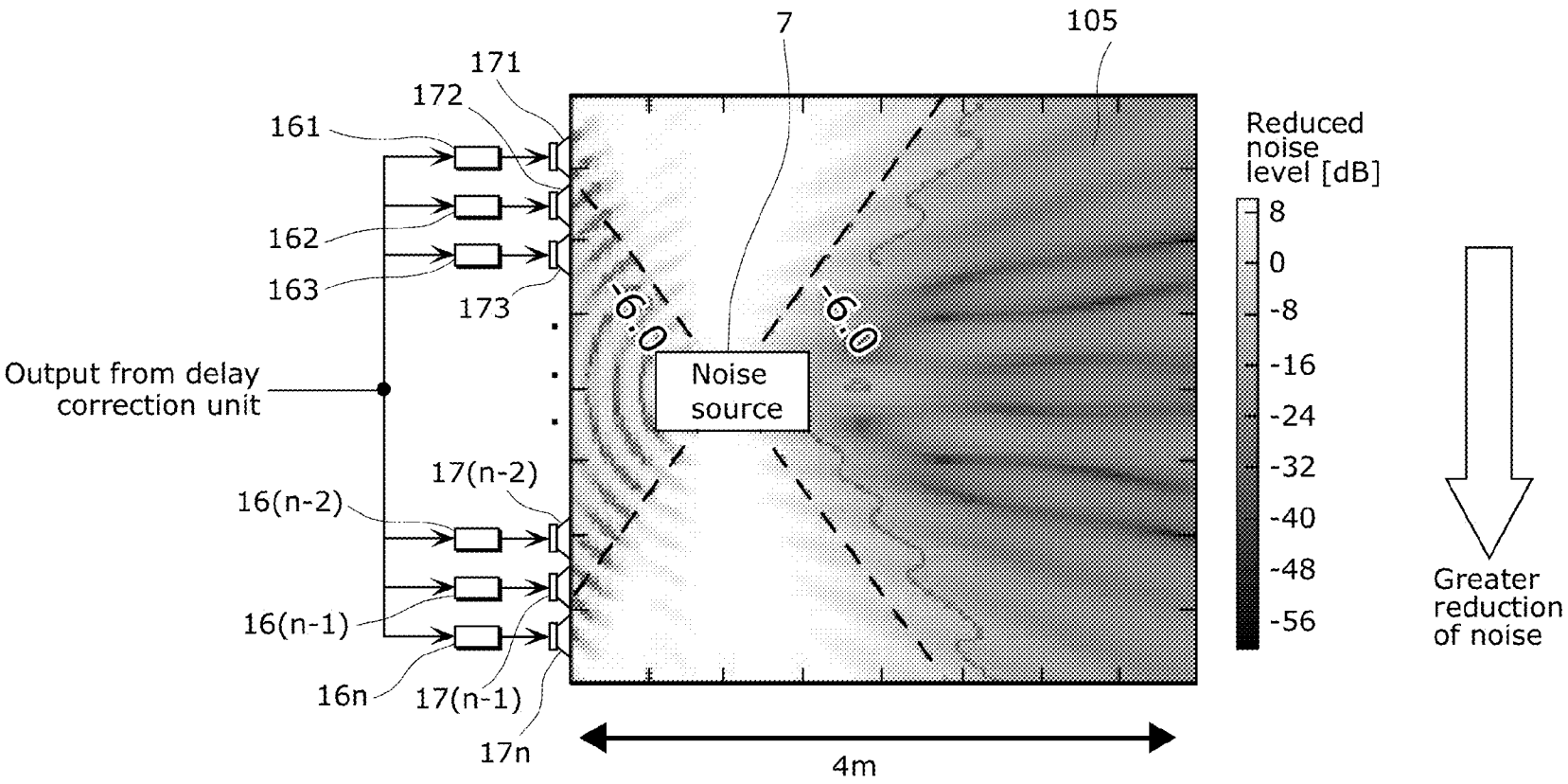
FIG. 11 illustrates a wave field showing an exemplary result of noise reduction by the active noise control device according to the embodiment 1 of the present invention.

FIG. 11 illustrates a wave field showing an exemplary result of noise reduction by the active noise control device 10. In FIG. 11, the noise source 7 is represented as the point sound source similar to FIG. 6, and a distribution of reduced noise levels for 1.5 kHz component of the target sound is shown. It was found that the reduced noise levels are more than 6 dB in the large area where the synthesized-sound wave fronts 11*w* overlap with the noise wave fronts 7*w* (the right side area 105 of the noise source 7). On the other hand, in the lower side area 107 of the noise source 7, the target sound is not reduced.

Thus, referring to FIG. 11 and FIG. 2B, in a TV viewing area 103 which is located in the traveling direction of the target sound emitted from the speakers 102*a*, 102*b* of the TV 102, a sound emitted from the speakers 102*a*, 102*b* can be heard as usual since the TV viewing area is covered by the area 107 where the target sound is not reduced. Meanwhile, in the target area for sound control 104 which is located on the right side of the speakers 102*a*, 102*b*, the sound emitted from the speakers 102*a*, 102*b* can not be heard since the target area for sound control is covered by the area 105 where the synthesized-sound wave fronts 11*w* overlap with the noise wave fronts 7*w*. For example, when both a living area and a dining area are in a room 101 and the living area and the dining area are located in the TV viewing area 103 and the target area for sound control 104, respectively, people in the TV viewing area 103 (the living area) can watch TV 102 as usual and people in the target area for sound control 104 (the dining area) can talk as usual because the sound from TV 102 is canceled out to a negligible level.

As described above, the active noise control device 10 according to the embodiment 1 creates the virtual sound source 11 which is located at the position of the noise source 7 and from which the synthesized-sound wave front having an opposite phase to the noise wave front is generated, and thus the control speakers 171 to 17*n* need not be arranged around the noise source 7 and both applications to various noise environments and noise reduction in a large area can be achieved.

It should be noted that, in the equation (2) of the embodiment 1, the amount of delay $\Delta_T$ is determined based on all of the detected signals from the microphones 8*a* to 8*e*, but, among the time delays $\tau_{H1}$ to $\tau_{H5}$ and $\tau_{C1}$ to $\tau_{C5}$, the time delay which exceeds a predetermined time may be eliminated from the calculation of the equation (2).

Embodiment 2

An active noise control device according to an embodiment 2 of the present invention is described with reference to the drawings.

The embodiment 2 assumes that a target sound is a periodic noise generated from an equipment used in a home, an office, or the like for example. It is also assumed that a target area for sound control is a space (room) where the equipment is used.

The active noise control device 10 according to the embodiment 2 further includes a detection unit (not shown) for detecting the target sound in addition to components included in the active noise control device 10 according to the embodiment 1 (a reverse unit 12, a delay correction unit 13, a wavefront calculation unit 14, a delay amount control unit 15, a wavefront control unit 9 including a digital filtering unit 16 and a setup signal generation unit 18, a sound output unit 17, an input signal terminal, and one or more detection signal terminals) as shown in FIG. 3.

(Operation of Active Noise Control Device according to Embodiment 2)

Next, an operation of the active noise control device 10 according to the embodiment 2 is described. The active noise control device 10 also performs a usual sound control operation and a delay setup operation for setting the amount of delay to be used for the sound control operation in the same manner as the embodiment 1.

(Sound Control Operation)

The usual sound control operation is described. This embodiment assumes that the target sound is the periodic noise as mentioned above, so the following paragraphs describe a scenario in which a signal obtained by detecting the target sound at a position of a noise source 7 is used as an input signal.

Fist, active noise control device 10 receives the input signal under a condition that (i) the target sound is being emitted from the noise source 7 and (ii) control sounds are not being produced. The reverse unit 12 generates a reverse signal by reversing a phase of the input signal received when the control sounds are not produced. In this embodiment, since the target sound is assumed to be the periodic noise, a unit reverse signal for one period is generated and then the unit reverse signal is repeatedly provided to the delay correction unit 13. The reverse unit 12 detects a repetitive pattern by analyzing the waveform of the input signal to generate the unit reverse signal. It should be noted that, during the sound control operation, upon detecting only a synthesized sound in a monitoring period of the input signal, provision of the unit reverse signal may be stopped.

In the same manner as the embodiment 1, upon receiving the reverse signal provided from the reverse unit 12, the delay correction unit 13 provides an amount of delay, which is determined by the delay amount control unit 15 in a delay setup operation, to the reverse signal, and then provides the delayed reverse signal (a delay correction process).

In the same manner as the embodiment 1, a control filter 16*i* (i=1 to n) also performs a digital filtering on the delayed reverse signal, and activates a control speaker 17*i* to produce a control sound (an activation process). With this, the target sound within the target area for sound control can be canceled out.

(Delay Setup Operation)

In a delay setup operation, first, the wavefront calculation unit 14 calculates noise transfer functions for a position of a detection device 8 based on the input signal and the detected signal under the condition that (i) the target sound is being emitted from the noise source 7 and (ii) the control sounds are not being produced by the respective control speakers 171 to 17*n* (a noise transfer function calculation process).

Next, the wavefront calculation unit 14 calculates synthesized-sound transfer functions for a synthesized-sound wave front 11*w* (a synthesized-sound transfer function calculation process). It should be noted that a method of calculating the synthesized-sound transfer functions in the embodiment 2 is the same as a method in the embodiment 1.

Subsequently, the delay amount control unit 15 determines the amount of delay to the reverse signal based on the noise transfer functions and the synthesized-sound transfer functions calculated in the wavefront calculation unit 14 so that the synthesized-sound wave front 11*w* propagates at the same timing as a noise wave front 7*w*. It should be noted that, in the embodiment 2, the amount of delay is determined by calculating an average of the differences $\Delta_T$ between the time delays of the impulse responses, in the same manner as the embodiment 1.

Embodiment 3

Figure 12:
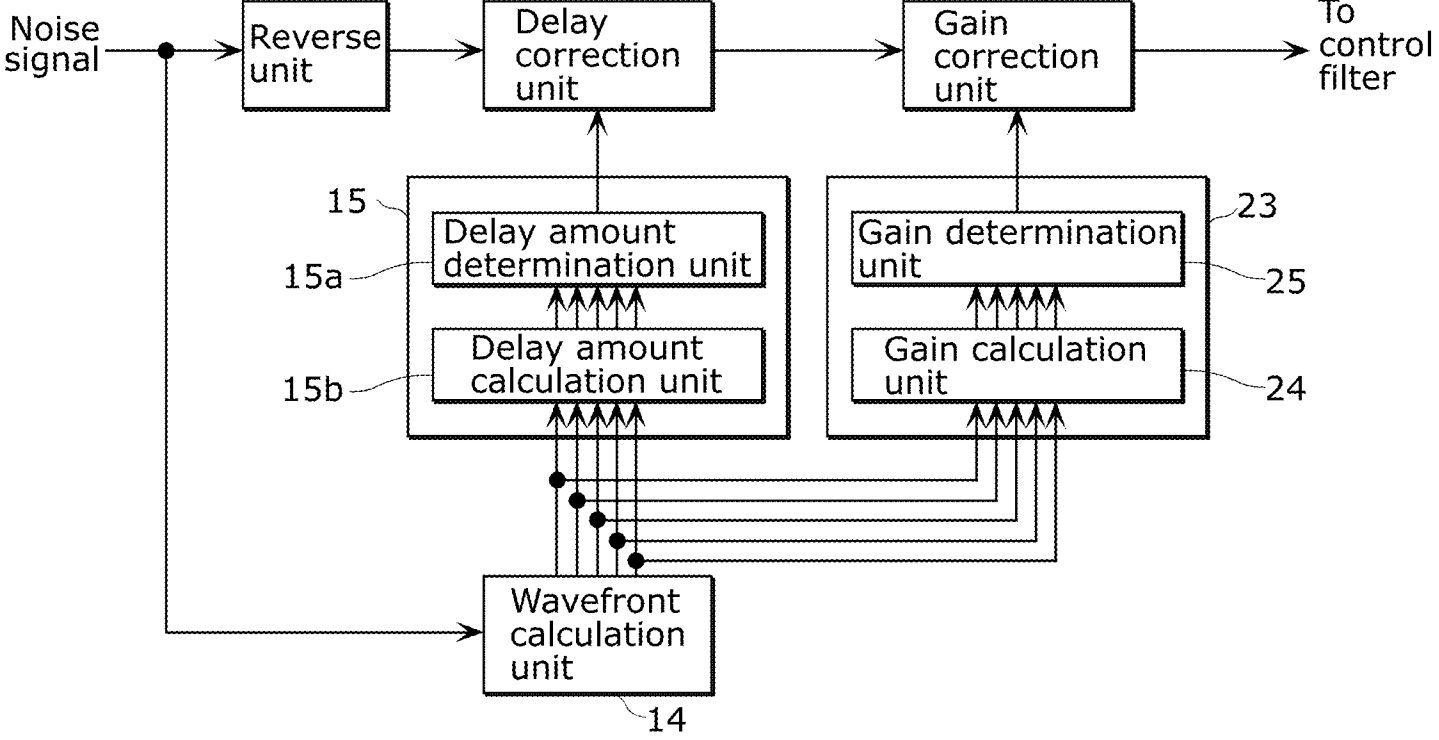
FIG. 12 illustrates a schematic partial block diagram showing an additional component for correcting a gain in the active noise control device according to an embodiment 3 of the present invention.

An active noise control device according to an embodiment 3 of the present invention is described with reference to FIG. 12.

The active noise control device 10 according to the embodiment 3 is different from the active noise control device 10 according to the embodiments 1 and 2 in that a gain of a delayed reverse signal can be corrected.

By adjusting a gain in addition to a propagation timing (an amount of delay) between the noise wave front 7*w* and the synthesized-sound wave front 11*w* as shown in FIG. 5, the synthesized-sound wave front 11*w* more closely coincides with the noise wave front 7*w*.

(Structure of Active Noise Control Device according to Embodiment 3)

A structure of the active noise control device according to the embodiment 3 is described with reference to FIG. 12. FIG. 12 illustrates a part of the active noise control device, i.e. blocks related to the gain correction. As shown in FIG. 12, the active noise control device according to the embodiment 3 includes a gain correction unit 22 and a gain control unit 23 in addition to components included in the active noise control device according to the embodiments 1 and 2 (a reverse unit 12, a delay correction unit 13, a wavefront calculation unit 14, a delay amount control unit 15, a digital filtering unit 16, a sound output unit 17, and a setup signal generation unit 18) as shown in FIG. 3

It should be noted that structures of the reverse unit 12, the delay correction unit 13, the wavefront calculation unit 14, the delay amount control unit 15, the digital filtering unit 16, the sound output unit 17, and the setup signal generation unit 18 are the same as those of the embodiments 1 or 2.

The gain correction unit 22 adjusts a gain of a delayed reverse signal provided from the delay correction unit 13 using a gain correction value determined in the gain control unit 23.

The gain control unit 23 includes a gain calculation unit 24 and a gain determination unit 25. The gain calculation unit calculates gains $g_{H1}$ to $g_{H5}$ of noise transfer functions corresponding to microphones 8*a* to 8*e*, respectively, which have been calculated in the wavefront calculation unit 14. The gain calculation unit also calculates gains $g_{C1}$ to $g_{c5}$ of synthesized-sound transfer functions corresponding to the microphones 8*a* to 8*e*, respectively, which also have been calculated in the wavefront calculation unit 14. The gain determination unit 25 determines the gain correction value based on the gains calculated in the gain calculation unit 24.

In the gain determination unit 25, the gain correction value is calculated from the following equation (3) using the gains $g_{H1}$ to $g_{H5}$ of the noise transfer functions and the gains $g_{C1}$ to $g_{C5}$ of the synthesized-sound transfer functions.

[Math. 3]

$$\Delta g = \frac{\sum_{n=1}^{5} g_{Hi}}{5} - \frac{\sum_{n=1}^{5} g_{Ci}}{5} \tag{3}$$

According to the embodiment 3, the gain of the delayed reverse signal is adjusted and then the wavefront control signal is generated. Therefore, the synthesized-sound wave front 11*w* more closely coincides with the noise wave front 7*w*, the target sound is more largely canceled out, and the target area for sound control is further expanded.

Embodiment 4

An active noise control device according to an embodiment 4 of the present invention is described with reference to FIG. 13 and FIG. 14.

The active noise control device 10 according to the embodiment 4 is different from the active noise control device 10 according to the embodiments 1 to 3 in that a user can change positions of control speakers 171 to 17*n* of the active noise control device and a position of a virtual sound source 11.

In other words, when the positions of the control speakers and the position of the virtual sound source 11 are changed, the active noise control device 10 according to the embodiment 4 performs a filter coefficient determination operation in which filter coefficients $Q_1(\omega)$ to $Q_n(\omega)$ to be used in the digital filtering unit 16 are determined, before performing a sound control operation and a delay setup operation.

Figure 13:
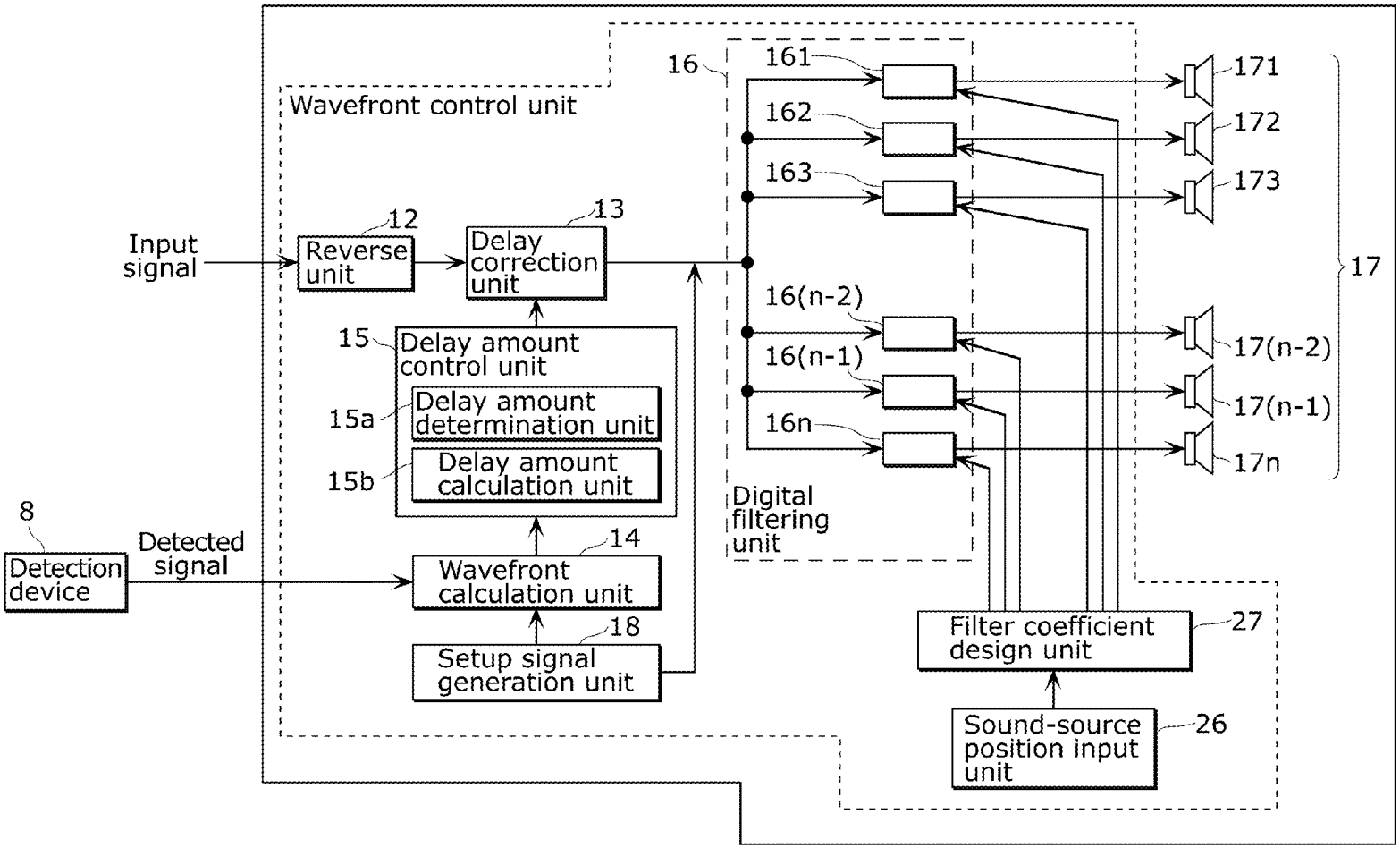
FIG. 13 illustrates a schematic block diagram showing an exemplary structure of the active noise control device according to an embodiment 4 of the present invention.

FIG. 13 illustrates a schematic block diagram showing an exemplary schematic structure of the active noise control device 10 according to the embodiment 4.

As shown in FIG. 13, the active noise control device 10 according to the embodiment 4 includes a wavefront control unit 9, a sound output unit 17, an input signal terminal (not shown), and one or more detection signal terminals (not shown), like the embodiment 1. In the embodiment 4, the wavefront control unit 9 includes a reverse unit 12, a delay correction unit 13, a wavefront calculation unit 14, a delay amount control unit 15, a digital filtering unit 16, a setup signal generation unit 18, a sound-source position input unit 26, and a filter coefficient design unit 27. It should be noted that structures of the reverse unit 12, the delay correction unit 13, the wavefront calculation unit 14, the delay amount control unit 15, the digital filtering unit 16, and the setup signal generation unit 18 are the same as those of the embodiment 1.

In the filter coefficient determination operation, the sound-source position input unit 26 receives, by a user's input, position information indicating positions of control speakers 171 to 17*n* and a position of a noise source 7. FIG. 14 illustrates a view showing a frame format of parameters used in a calculation of a filter coefficient according to a wave field synthesis theory. In FIG. 14, Cartesian coordinate system is used like FIG. 4, and the control speakers 171 to 17*n* are arranged along the y-axis.

More specifically, the sound-source position input unit 26 receives the position information indicating coordinate data $(x_i, y_i)$ of the control speaker 17*i* and coordinate data $(x_0, y_0)$ of the virtual sound source 11 by the user's input. It should be noted that the embodiment 4 describes, for illustrative purpose, a scenario in which the sound-source position input unit 26 separately receives the positions of the control speakers 171 to 17*n*. It should be also noted that the sound-source position input unit 26 may receive the position of the reference control speaker 17*i* and distances between the control speakers to calculate the positions of the other control speakers. Alternatively, the sound-source position input unit 26 may receive the positions of the control speakers 171 and 17*n*, which are located at the end of a line of the control speakers, to calculate the positions of the other control speakers. Another structure is also possible. Moreover, in the embodiment 4, the position of the control speaker 17*i* and the position of the virtual sound source 11 are set using Cartesian coordinate system, but not limited to this. Furthermore, the position information may be received in other ways instead of the user's input.

The sound-source position input unit 26 calculates a length $r_i$ of a line segment between the control speaker 17*i* and the virtual sound source 11 and an angle $\phi_i$ between a x-axis and the line segment based on the received position information using the equations (4) and (5).

[Math. 4]

$$r_i = \sqrt{(x_0 - x_i)^2 + (y_0 - y_i)^2} \tag{4}$$

[Math. 5]

$$\phi_i = \arctan\frac{|y_0 - y_i|}{|x_0 - x_i|} \tag{5}$$

The filter coefficient design unit 27 calculates the filter coefficients $Q_1(\omega)$ to $Q_n(\omega)$ to be used in the digital filtering unit 16 using the length $r_i$ and the angle $\phi_i$ calculated in the sound-source position input unit 26, and sets up the control filters 161 to 16*n* in the digital filtering unit 16. The filter coefficients $Q_1(\omega)$ to $Q_n(\omega)$ are calculated using the equation (1) described in the embodiment 1. The filter coefficient design unit 27 provides the calculated filter coefficients $Q_1(\omega)$ to $Q_n(\omega)$ to the control filters 161 to 16*n*, respectively.

In the embodiment 4, a user can locate the control speakers 171 to 17*n* and the virtual sound source 11 anywhere in the room depending on the position of the noise source 7 or a layout of the room 101, by a simple setup operation. With this, the active noise control device 10 can be applied to the various environments where the noise is generated.

It should be noted that, in the embodiment 4, for illustrative purpose, the sound-source position input unit 26 and the filter coefficient design unit 27 are further included in the active noise control device 10 of the embodiment 1, but the sound-source position input unit 26 and the filter coefficient design unit 27 may be further included in the active noise control device 10 of the embodiment 2 or 3.

Other Embodiments (1) A wavefront control unit 9 of an active noise control device 10 according to the embodiments 1 to 4 is typically implemented as a large-scale integration (LSI) circuit, which is an integrated circuit. Components included in the wavefront control unit 9 (a reverse unit 12, a delay correction unit 13, a wavefront calculation unit 14, a delay amount control unit 15, a digital filtering unit 16, a sound output unit 17, a setup signal generation unit 18, a gain correction unit 22, and a gain control unit 23) may be integrated into a separate single chip, or some or all of the components may be integrated into a single chip. For example, functional blocks other than a memory (processing units) may be integrated into a single chip and a general-purpose memory may be used for the memory. Alternatively, among the functional blocks, only a unit for storing parameters, filter coefficients, or the like may be excluded from integration into a single chip and configured otherwise and the other functional blocks may be integrated into a single chip. The name used here is a system LSI, however, it may also be referred to as an IC, an LSI, a super LSI, or an ultra LSI in accordance with the degree of integration. The integration may be achieved, not only as a LSI, but also as a dedicated circuit or a general purpose processor. Also applicable is a field programmable gate array (FPGA), which allows post-manufacture programming, or a reconfigurable processor LSI, which allows post-manufacture reconfiguration of connection and setting of circuit cells therein. Furthermore, in the event that an advance in or derivation from semiconductor technology brings about an integrated circuitry technology whereby an LSI is replaced, the functional blocks may be obviously integrated using such new technology. The adaptation of biotechnology or the like is possible.

(2) The wavefront control unit 9 according to the present invention may be implemented not only as such an integrated circuit but also as: a computer program which causes a computer to execute steps of the wavefront control unit 9; information, data, or a signal which represents such a computer program. The aforementioned computer includes, specifically, a microprocessor, a ROM, a RAM, a hard disk unit, a display unit, a keyboard, a mouse, and the so on. A computer program is stored in the RAM or hard disk unit. The wavefront control unit 9 achieves the function through the microprocessor's operation according to the computer program. The computer program is configured by combining plural instruction codes indicating instructions for the computer in order to achieve the predetermined function.

The computer program, and the information, data, or signal which represents such the computer program may be realized by storing them in a computer readable recording medium such as a flexible disc, a hard disk, an MO, a DVD, a DVD-ROM, a DVD-RAM, a BD (Blu-ray Disc), a semiconductor memory, an IC card, and a CD-ROM, and may be also distributed via a telecommunication line, a wireless or wired communication line, a network represented by the Internet, a data broadcast, and so on.

Furthermore, the components included in the wavefront control unit 9 (the reverse unit 12, the delay correction unit 13, the wavefront calculation unit 14, the delay amount control unit 15, the digital filtering unit 16, the sound output unit 17, the setup signal generation unit 18, the gain correction unit 22, and the gain control unit 23) may be implemented as a single computer program, or one or some of the components may be implemented as a single subprogram which is combined with other subprograms.

The embodiments of the present invention are described above with reference to the drawings, but the present invention is not limited to such embodiments. The above embodiments can be modified or altered within the same or equivalent scope of the present invention.

INDUSTRIAL APPLICABILITY

The active noise control device according to the present invention is useful as an equipment used in a home, an office, or the like since a target sound is canceled out in the intended target area for sound control. The active noise control device is also applicable for use as an equipment in a railway or ship cabin.

REFERENCE SIGNS LIST

1 Air-conditioning indoor equipment
2 Turbofan
3 Exchanger
4 Suction grille
5 Sound generation unit
5*a* to 5*e* Speakers
6 Air flow channel
7 Noise source
7*w* Noise wave front
8 Detection device
8*a* to 8*e* Microphones
9 Wavefront control unit
10 Active noise control device
11 Virtual sound source
11*w* Synthesized-sound wave front
12 Reverse unit
13 Delay correction unit
14 Wavefront calculation unit
15 Delay amount control unit
15*a* Delay amount determination unit
15*b* Delay amount calculation unit
16 Digital filtering unit
161 to 16*n* Control filters
17 Sound output unit
171 to 17*n* Control speakers
18 Setup signal generation unit
22 Gain correction unit
23 Gain control unit
24 Gain calculation unit
25 Gain determination unit
26 Sound-source position input unit
27 Filter coefficient design unit
102 TV
102*a*, 102*b* Speaker
103 TV viewing area
104 Target area for sound control

The invention claimed is:

1. An active noise control device for canceling out a target sound to be controlled in a target area for sound control desired, the active noise control device comprising:

a plurality of control sound output units each configured to produce a control sound based on a wavefront control signal; and a wavefront control unit configured to provide the wavefront control signal to the corresponding one of the control sound output units, wherein the wavefront control unit (i) includes a plurality of control filters each of which performs digital filtering using a filter coefficient for a corresponding one of the control sound output units, and (ii) is configured to generate, by the digital filtering performed by the corresponding one of the control filters, the wavefront control signal to emit a synthesized sound from a virtual sound source toward the target area for sound control and cancel out the target sound in the target area for sound control, the synthesized sound being a sound synthesized from control sounds produced by the respective control sound output units, and the virtual sound source being located at a predetermined position.

2. The active noise control device according to claim 1, wherein, when a non-target area for sound control is located in a traveling direction of the target sound emitted from a noise source and the target area for sound control is located in a different direction from the traveling direction, the non-target area for sound control being an area where the target sound can be heard, the wavefront control unit is configured to generate the wavefront control signal to emit the synthesized sound from the virtual sound source toward the different direction.

3. The active noise control device according to claim 1, wherein the wavefront control unit is configured to set the wavefront control signal for producing the synthesized sound having a phase opposite to a phase of the target sound in the target area for sound control and an amplitude equal to an amplitude of the target sound.

4. The active noise control device according to claim 1, wherein the wavefront control unit includes:

a reverse unit configured to generate a reverse signal by reversing a phase of an input signal to be used to generate the control sounds; and a delay correction unit configured to generate a delayed reverse signal by providing a predetermined amount of delay to the reverse signal, and each of the control filters is configured to generate the wavefront control signal by performing the digital filtering on the delayed reverse signal.

5. The active noise control device according to claim 4, wherein the wavefront control unit includes:

a wavefront calculation unit configured to perform (i) a noise transfer function calculation process in which a noise transfer function is calculated based on a detection result obtained by, under a condition that the target sound is being emitted, stopping production of the control sounds and detecting the target sound using a detection device for detecting a sound, and (ii) a synthesized-sound transfer function calculation process in which a synthesized-sound transfer function is calculated based on a detection result obtained by, under a condition that no target sound is being emitted, producing setup control sounds from the respective control output units and detecting a setup synthesized sound using the detection device, the setup synthesized sound being a sound synthesized from the setup control sounds; and a delay amount control unit configured to set the amount of delay based on the noise transfer function and the synthesized sound transfer function calculated in the wavefront calculation unit.

6. The active noise control device according to claim 5, wherein the wavefront control unit further includes:

a gain correction unit configured to adjust a gain of the delayed reverse signal based on a gain correction value; and a gain control unit configured to determine the gain correction value based on a noise transfer function and a synthesized sound transfer function calculated in a wavefront calculation unit, the gain correction value being a value for increasing a degree of coincidence between a wave front of the synthesized sound and a wave front of the target sound.

7. The active noise control device according to claim 5, wherein the detection device includes at least two microphones which are arranged at regular intervals along a circular arc formed by points having a same phase in the synthesized sound.

* * * * *

UNITED STATES PATENT AND TRADEMARK OFFICE

CERTIFICATE OF CORRECTION

PATENT NO. : 9,076,424 B2
APPLICATION NO. : 13/701532
DATED : July 7, 2015
INVENTOR(S) : Ko Mizuno It is certified that error appears in the above-identified patent and that said Letters Patent is hereby corrected as shown below:

In The Drawings

Figure 14:
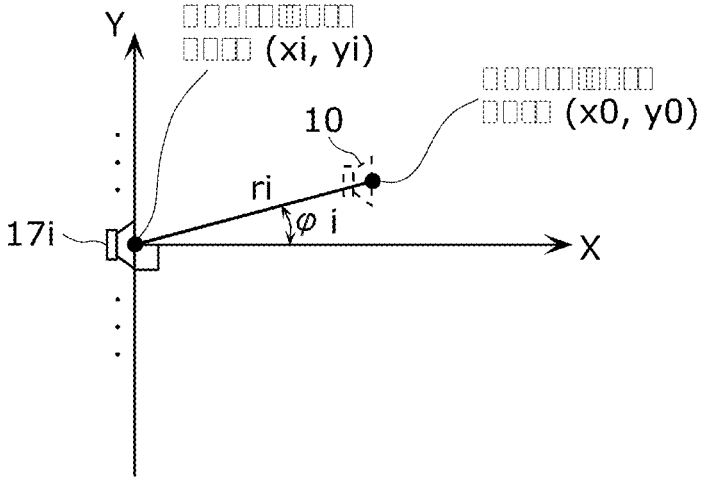
FIG. 14 illustrates a view showing a frame format of parameters used in the calculation of the filter coefficient according to the wave field synthesis theory.
Figure 14:
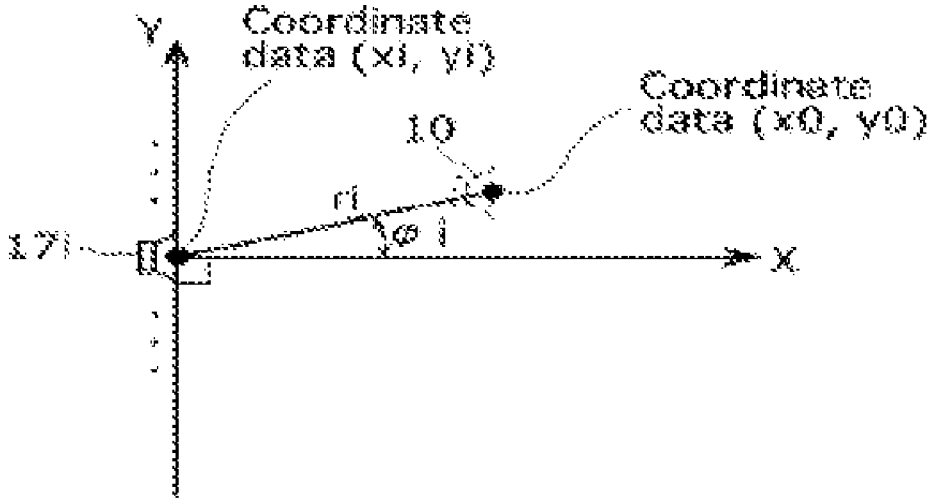

On sheet 13/13, Fig. 14 is replaced by the attached Figure.

Signed and Sealed this
Ninth Day of August, 2016

Michelle K. Lee

Michelle K. Lee
*Director of the United States Patent and Trademark Office*